US010017304B2

(12) United States Patent
Tsai

(10) Patent No.: US 10,017,304 B2
(45) Date of Patent: Jul. 10, 2018

(54) PACKING BOX, ELECTRONIC ASSEMBLY AND OPENING METHOD OF ELECTRONIC ASSEMBLY

(71) Applicant: HTC Corporation, Taoyuan (TW)

(72) Inventor: I-Leh Tsai, Taoyuan (TW)

(73) Assignee: HTC Corporation, Taoyuan (TW)

( * ) Notice: Subject to any disclaimer, the term of this patent is extended or adjusted under 35 U.S.C. 154(b) by 118 days.

(21) Appl. No.: 14/689,064

(22) Filed: Apr. 17, 2015

(65) Prior Publication Data

US 2016/0309603 A1 Oct. 20, 2016

(51) Int. Cl.

| | |
|---|---|
| ***H01H 47/22*** | (2006.01) |
| ***H05K 5/00*** | (2006.01) |
| ***H05K 5/02*** | (2006.01) |
| ***B65D 51/24*** | (2006.01) |
| ***B65D 25/00*** | (2006.01) |

(52) U.S. Cl.
CPC ..... *B65D 51/24* (2013.01); *B65D 25/00* (2013.01)

(58) Field of Classification Search
None
See application file for complete search history.

(56) References Cited

U.S. PATENT DOCUMENTS

| | | | | |
|---|---|---|---|---|
| 2013/0192104 | A1 | 8/2013 | Coughlin et al. | |
| 2014/0138275 | A1* | 5/2014 | Magnusson | B65D 85/00 206/459.1 |
| 2014/0319021 | A1* | 10/2014 | Skarin | B42D 15/008 206/755 |
| 2015/0060310 | A1 | 3/2015 | Tseng | |

FOREIGN PATENT DOCUMENTS

| | | |
|---|---|---|
| TW | M411082 | 9/2011 |
| TW | 201502042 | 1/2015 |
| TW | 201507492 | 2/2015 |

OTHER PUBLICATIONS

"Office Action of Taiwan Counterpart Application" , dated Aug. 2, 2016, p. 1-p. 7.

* cited by examiner

*Primary Examiner* — Jared Fureman
*Assistant Examiner* — Aqeel Bukhari
(74) *Attorney, Agent, or Firm* — JCIPRNET

(57) ABSTRACT

A packing box suitable for an electronic device is provided. The packing box includes a box body and a box cover. The box cover is assembled on the box body and at least one part of the box cover is separable from the box body. The electronic device is accommodated between the box body and the box cover. When the box cover is separated from the box body, a predetermined function of the electronic device is triggered correspondingly with separating the box cover from the box body to actuate a trigger component of the electronic device. An electronic assembly and a method of opening an electronic assembly are also provided.

20 Claims, 5 Drawing Sheets

PACKING BOX, ELECTRONIC ASSEMBLY AND OPENING METHOD OF ELECTRONIC ASSEMBLY

BACKGROUND

Field of the Application

The application relates to a packing box, an electronic assembly and a method of opening an electronic assembly, and more particularly to a packing box, an electronic assembly applied to the packing box, and a method of opening the electronic assembly applied to the packing box.

Description of Related Art

In the information explosion era, people are more and more dependent on electronic products. Among all the electronic products, smart phones or tablet PC are most widely adopted due to their characteristics of being easy to carry and capable of receiving and sending instant messages. Since the electronic products are made with high precision, they are very likely to be damaged due to impact, shock or other external forces during transportation. Accordingly, the electronic products are normally placed in a packing box when being transported so the packing box can protect the electronic products from being damaged and reduce damage to them.

Generally speaking, the packing box not only can accommodate the electronic product, but also can receive specification as well as related accessories of the electronic product. On the other hand, in most cases, the appearance and model number of the electronic product are printed on the surface of the packing box so consumers can easily identify or read the information relating to the electronic products. Apart from that, the design of the appearance of the packing box may add value to the product and make it more likely for the consumers to buy the product. In light of the above, in addition to design the packing box with a more attractive appearance, it is also an issue as to how to add value to the product by making the design of the packing box to be more interactive or customized.

SUMMARY

The application provides a packing box suitable for packing an electronic device. In addition, a predetermined function of the electronic device can be correspondingly triggered with unpacking the packing box.

The application provides an electronic assembly, and an electronic device thereof is placed in the packing box. The predetermined function of the electronic device can be correspondingly triggered with unpacking the packing box.

The application provides a method of opening an electronic assembly, through which the predetermined function of the electronic device can be correspondingly triggered with separating the box cover of the packing box from the box body.

The application provides a packing box suitable for an electronic device. The packing box includes a box body and a box cover. The box cover is assembled on the box body and at least one part of the box cover is separable from the box body. The electronic device is accommodated between the box body and the box cover. When the box cover is separated from the box body, a trigger component of the electronic device is actuated with separating the box cover from the box body so as to correspondingly trigger the predetermined function of the electronic device.

The application provides an electronic assembly including a packing box and an electronic device. The packing box includes a box body and a box cover. The box cover is assembled on the box body and at least one part of the box cover is separable from the box body. The electronic device is accommodated between the box body and the box cover. The electronic device has a trigger component. When the box cover is separated from the box body, a trigger component is actuated with separating the box cover from the box body so as to correspondingly trigger the predetermined function of the electronic device.

The application provides a method of opening an electronic assembly. The electronic assembly includes a packing box and an electronic device. The packing box includes a box body and a box cover. The box cover is assembled on the box body and at least one part of the box cover is separable from the box body. The electronic device is accommodated between the box cover and the box body. The method of opening the electronic assembly includes the following steps, including separating the box cover from the box body, actuating the trigger component with separating the box cover from the box body to correspondingly triggering the predetermined function of the electronic device.

Based on the above, in the electronic assembly of the application, the electronic device is accommodated between the box body and the box cover of the packing box, wherein the box cover is assembled on the box body and at least one part of the box cover is separable from the box body. Accordingly, the consumer can take the electronic device out of the box body by simply separating the box cover from the box body. When the box cover is separated from the box body, the trigger component of the electronic device is actuated by the box cover to correspondingly trigger the predetermined function of the electronic device, for example, booting, playing images, playing videos, displaying text messages, playing audio signals or executing other applications. The feature may add value to the product by surprising the consumer with a new experience when unpacking the packing box to take out the electronic device.

In order to make the aforementioned features and advantages of the application more comprehensible, embodiments accompanying figures are described in detail below.

DESCRIPTION OF EMBODIMENTS

Figure 1A:
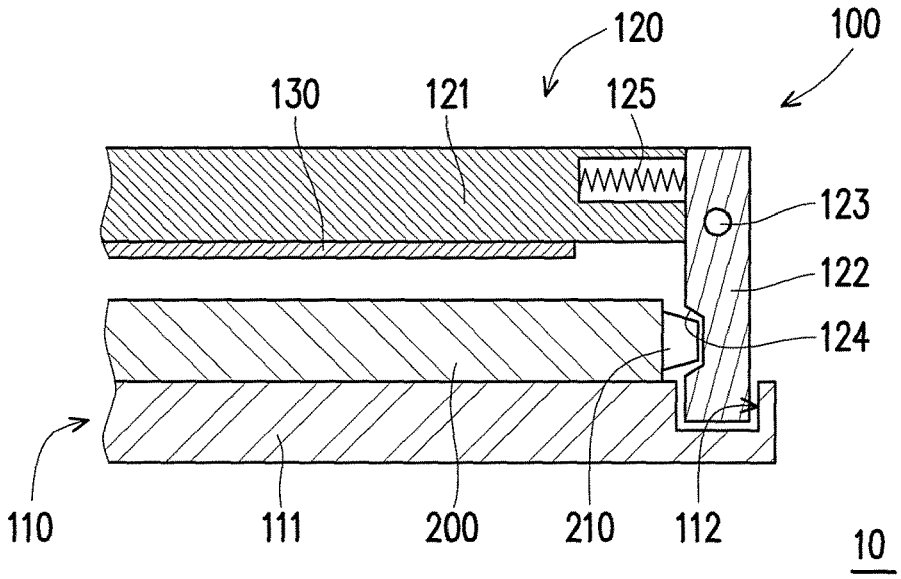
FIGS. 1A to 1C are partial sectional views illustrating a process of disassembling an electronic assembly according to an embodiment of the application.
Figure 1B:
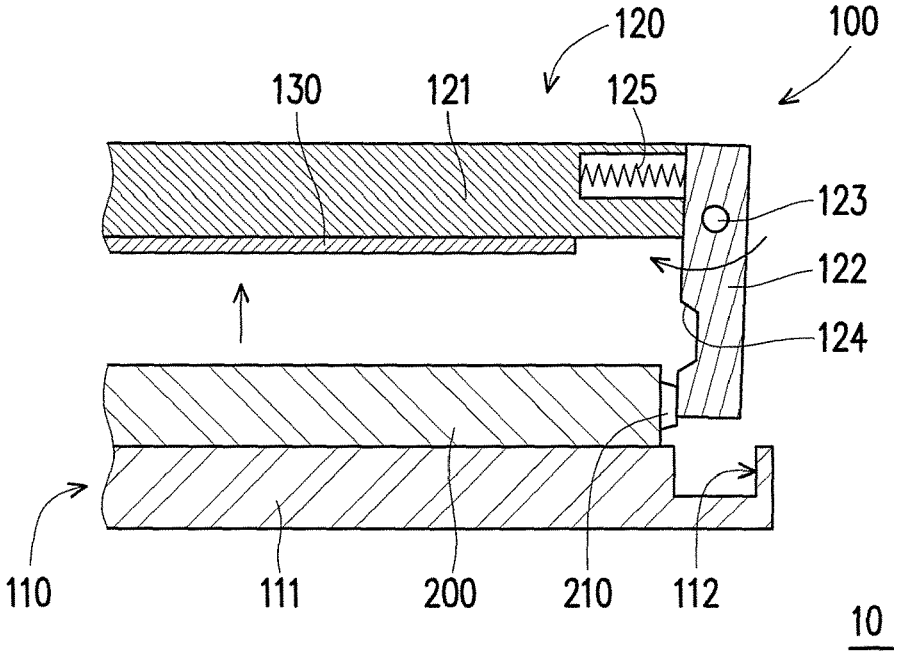
Figure 1C:
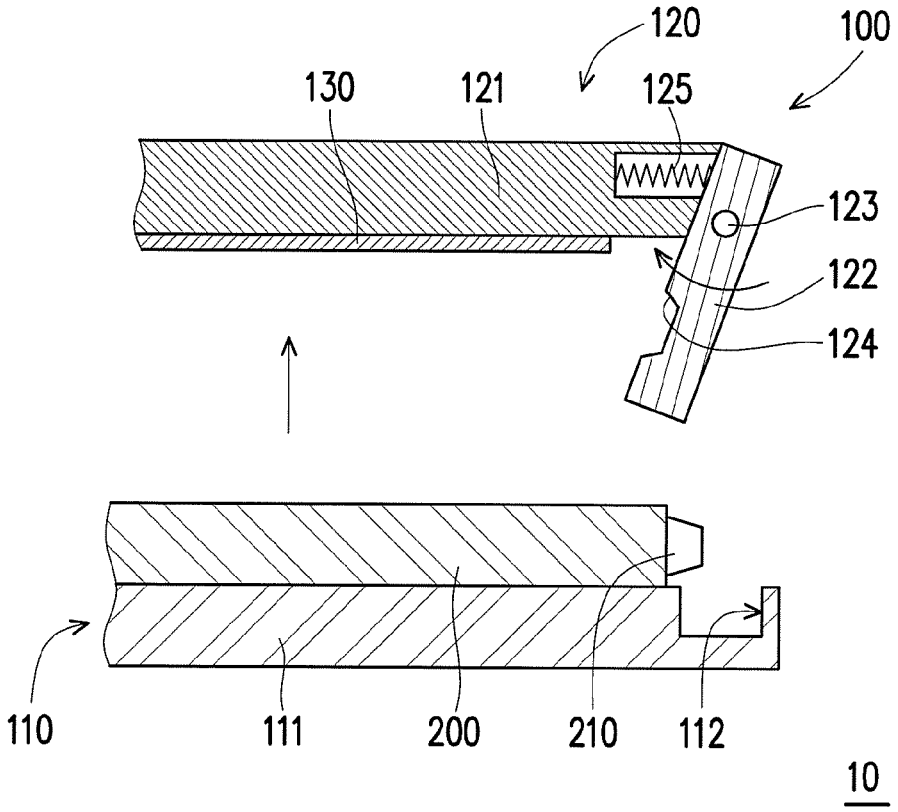

FIGS. 1A to 1C are partial sectional views illustrating a process of disassembling an electronic assembly according to an embodiment of the application. Please refer to FIG. 1A. In the embodiment, an electronic assembly 10 includes a packing box 100 and an electronic device 200 accommodated in the packing box 100. The electronic device 200 may be a smart phone, a tablet PC, a smart watch or smart glasses and so on. In the meantime, there may be one, two or more electronic devices 200 accommodated in the packing box 100. Generally speaking, the packing box 100 includes a box body 110 and a box cover 120, wherein the box body 110 and the box cover 120 may be formed of paper material, wood material, plastic or acrylic material.

After the electronic device 200 is placed into the box body 110, the box cover 120 is assembled on the box body 110 to cover the electronic device 200 such that the electronic device 200 is accommodated between the box body 110 and the box cover 120, as shown by FIG. 1A. Since the box cover 120 is assembled on the box body 110 and at least one part of the box cover 120 is separable from the box body 110, a consumer can take the electronic device 200 out of the box body 110 by simply separating the box cover 120 from the box body 110. Specifically, the box body 110 has a first plate portion 111, the box cover 120 has a second plate portion 121 and an actuation portion 122 which is movably connected to the second plate portion 121, wherein the actuation portion 122 may move (e.g., rotate or translate) with respect to the second plate portion 121. In the embodiment, the actuation portion 122 may be pivoted on the second plate portion 121 via a pivot member 123 and therefore may rotate with respect to the second plate portion 121. On the other hand, the electronic device 200 is disposed between the first plate portion 111 and the second plate portion 121. The electronic device 200 has a trigger component 210. The actuation portion 122 is disposed to extend toward the first plate portion 111 and correspond to the trigger component 210.

In the embodiment, the actuation portion 122 has a recess 124 disposed corresponding to the trigger component 210 such that an interval is kept between the actuation portion 122 and the trigger component 210. In addition, the box body 110 further has a limiting groove 112 disposed in the first plate portion 111. When the box cover 120 is assembled on the box body 110 (i.e., when the box cover 120 is not separated from the box body 110), the actuation portion 122 may be fixed within the limiting groove 112 so as to prevent the actuation portion 122 from actuating the trigger component 210 by accident.

Next, please refer to FIG. 1B. When the box cover 120 is separated from the box body 110, the actuation portion 122 moved out of the limiting groove 112 may move toward the trigger component 210 with respect to the second plate portion 121 so as to actuate the trigger component 210. The trigger component 210 is, for example, a power key switch of the electronic device 200, which may correspondingly generate a triggering signal after being actuated by the actuation portion 122. The triggering signal may be transmitted to a central processing unit (not shown) via an internal circuit (not shown). The central processing unit (not shown) may control the electronic device 200 to execute a corresponding predetermined function according to the received triggering signal, such as booting, playing picture, playing images or playing audio signal. That is to say, the trigger component 210 may be actuated with separating the box cover 120 from the box body 110 so as to correspondingly trigger the predetermined function of the electronic device 200. Accordingly, when the consumer unpacks the packing box 100 to take out the electronic device 200, the consumer may feel surprised by the new experience, which further adds value to the products. For example, the predetermined function may be a starting picture, playing images, playing videos, displaying text messages, playing audio signal or executing other applications customized according to the consumer's need; the application is not limited thereto.

In order for the actuation portion 122 to automatically move toward the trigger component 210 with respect to the second plate portion 121 after being moved out of the limiting groove 112, the box cover 120 has an elastic member 125 (e.g., a compressed spring) which connects the second plate portion 121 and the actuation portion 122. In the embodiment, the elastic member 125 is disposed at a position adjacent to a position where the second plate portion 121 is pivoted to the actuation portion 122. In the meantime, the elastic member 125 is connected to an end portion of the actuation portion 122 away from the recess 124 and the second plate portion 121. When the actuation portion 122 is fixed in the limiting groove 112, the elastic member 125 is in a compressed state while being pressed by the end portion of the actuation portion 122 away from the recess 124 and stores elastic potential energy, as shown by FIG. 1A. Moreover, after the actuation portion 122 is moved out of the limiting groove 112, the elastic member 125 is suitable for releasing the elastic potential energy to push the end portion of the actuation portion 122 away from the recess 124, thereby driving the actuation portion 122 to move toward the trigger component 210 with respect to the second plate portion 121, as shown by FIG. 1B. Here, the elastic member 125 is, for example, a compressed spring; however, the application is not limited thereto. In other embodiments, the elastic member 125 may also be a torsion spring or other suitable elastic members.

Finally, please refer to FIG. 1C, which shows that the box cover 120 is continuously separated from the box body 110 so that the actuation portion 122 no longer abuts on the trigger component 210. On the other hand, the packing box 100 further includes a card 130 which is disposed between the first plate portion 111 and the second plate portion 121 in a manner of being able to adhered to the second plate portion 121. After the box cover 120 is separated from the box body 110, the card 130 is exposed so the consumer may read the text or picture on the card 130. For instance, the card 130 may be a card made of paper or electronic paper. In another embodiment that is not shown, the card 130 may also be placed in an envelope (not shown). After the box cover 120 is separated from the box body 110, the envelope with the card 130 is exposed so the consumer may take out the card 130 of the envelope to read the text or picture on the card 130.

Figure 1D:
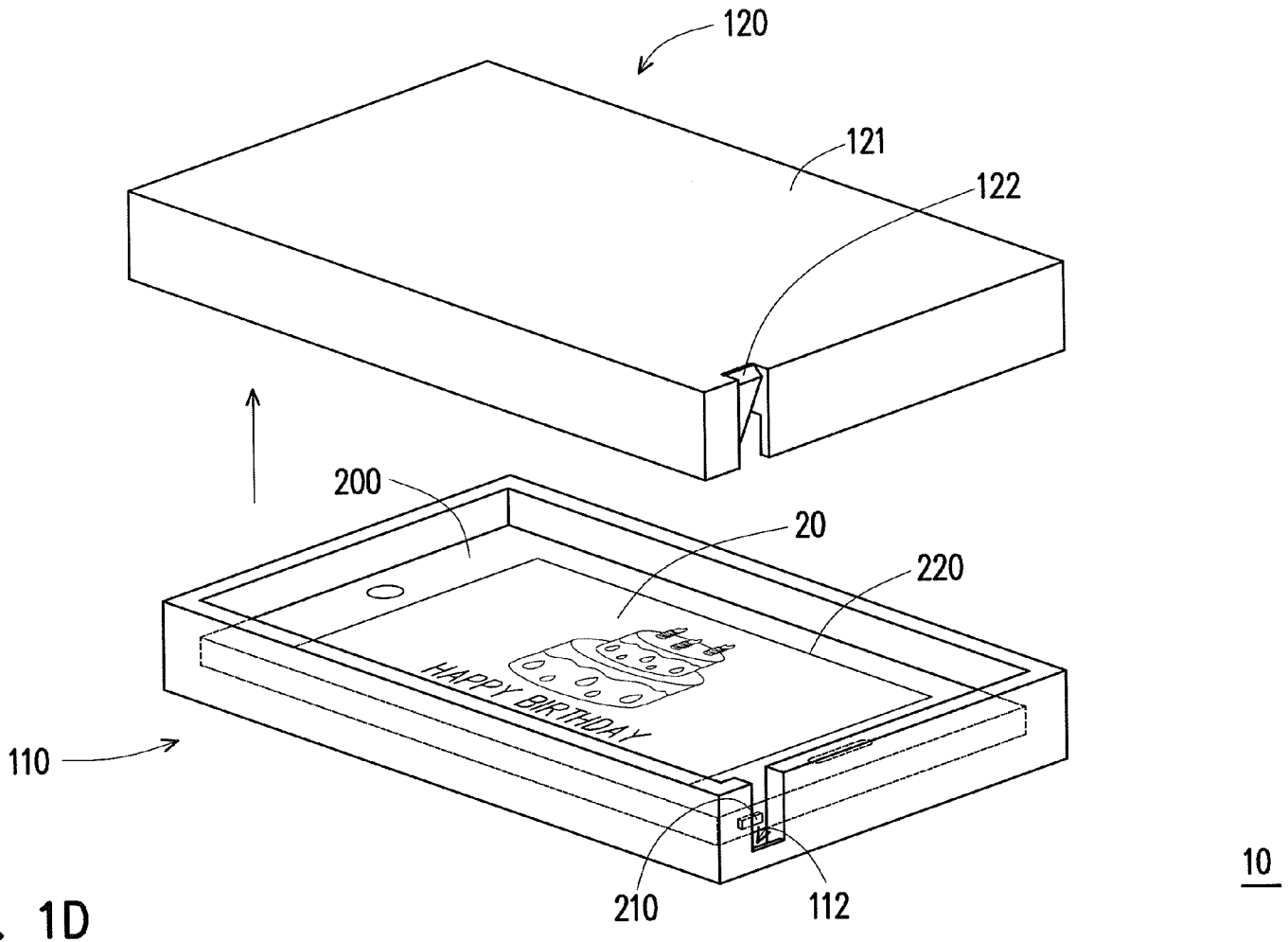
FIG. 1D is a three dimensional schematic view illustrating the electronic assembly shown by FIG. 1C.

FIG. 1D is a three dimensional schematic view illustrating the electronic assembly shown by FIG. 1C. Please refer to FIGS. 1B to 1D. In the process where the box cover 120 is separated from the box body 110, the box cover 120 may actuate the trigger component 210 of the electronic device 200 via the actuation portion 122 so as to trigger the predetermined function of the electronic device 200. The predetermined function is, for example, making the electronic device 200 to display an electronic card 20 on a screen 220. The content of the electronic card 20 may be customized pictures, text messages or images according to the consumer's need.

Although it is exemplified in the above embodiment that the box cover 120 is completely separated from the box cover 110, in another embodiment, when the box cover 120 is separated from the box body 110, at least one side of the box cover 120 is still connected to the box body 110, wherein the at least one side of the box cover 120 is, for example, the side with respect to the side where the actuation portion 122 is disposed.

More embodiments are incorporated below for descriptions. It should be noted that the following embodiments have adopted component notations and part of the contents from the previous embodiment, wherein the same notations are used for representing the same or similar components, and descriptions of the same technical contents are omitted. The descriptions regarding to the omitted part may be referred to the previous embodiment, and thus is not repeated herein.

Figure 2:
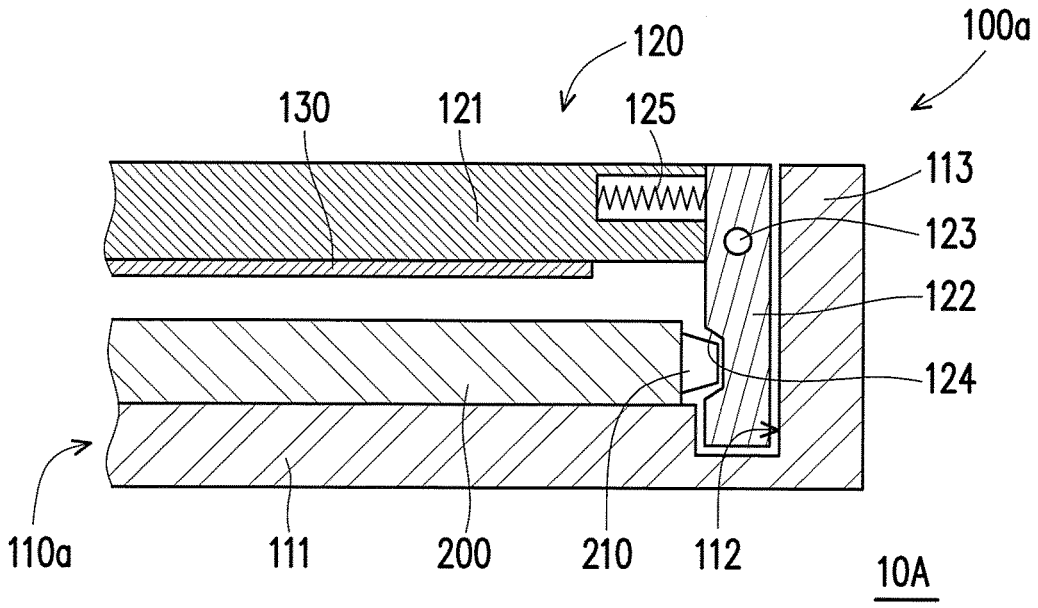
FIG. 2 is a partial sectional view illustrating an electronic assembly according to another embodiment of the application.

FIG. 2 is a partial sectional view illustrating an electronic assembly according to another embodiment of the application. Please refer to FIG. 2. In FIG. 2, an electronic assembly 10A is substantially similar to the electronic assembly 10 shown by FIG. 1A. The main difference of them lies in that a box body 110*a* of a packing box 100*a* of the electronic assembly 10A further has a limiting portion 113 connected to the first plate portion 111. The limiting portion 113 is substantially perpendicular to the first plate portion 111 and disposed at one side of the actuation portion 122. Since the limiting portion 113 is connected to the limiting groove 112, after an electronic device 200 is accommodated between the box body 110*a* and the box cover 120 and the actuation portion 122 is fixed in the limiting groove 112, the actuation portion 122 may be positioned between the limiting portion 113 and the electronic device 200. Specifically, the configuration of the limiting portion 113 and the limiting groove 112 may allow the actuation portion 122 to be firmly fixed on the first plate portion 111 to prevent the actuation portion 122 from actuating the trigger component 210 by accident.

Figure 3:
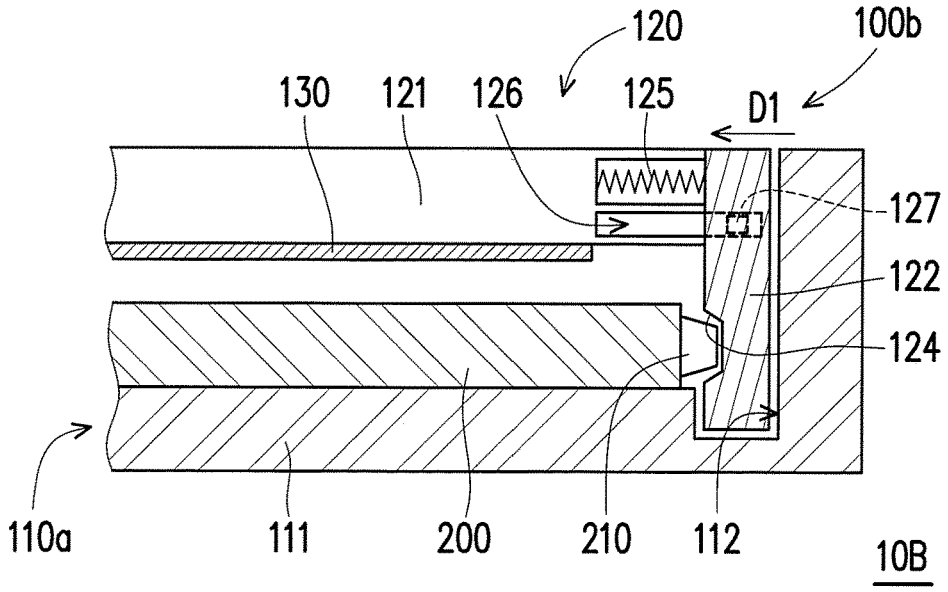
FIG. 3 is a partial sectional view illustrating an electronic assembly according to another embodiment of the application.

FIG. 3 is a partial sectional view illustrating an electronic assembly according to another embodiment of the application. Please refer to FIG. 3. In FIG. 3, an electronic assembly 10B is substantially similar to the electronic assembly 10A shown by FIG. 2. The main difference of them lies in that the actuation portion 122 of the box cover 120 of the packing box 100*b* is disposed in a manner to be able to translate on the second plate portion 121. Specifically, the second plate portion 121 may be provided with a guiding groove 126. The actuation portion 122 is coupled to the guiding groove 126 via a guiding block 127 to be suitable for moving back and forth with respect to the second plate portion 121 along a direction D1 or a reverse direction. The guiding groove 126 is disposed at one side of the elastic member 125. Here, the elastic member 125 is, for example, a tensile spring. When the box cover 120 is separated from the box body 110, the actuation portion 122 moved out of the limiting groove 112 may be pulled by the elastic member 125 to translate toward the trigger component 210 along the direction D1 with respect to the second plate portion 121 so as to actuate the trigger component 210.

Figure 4:
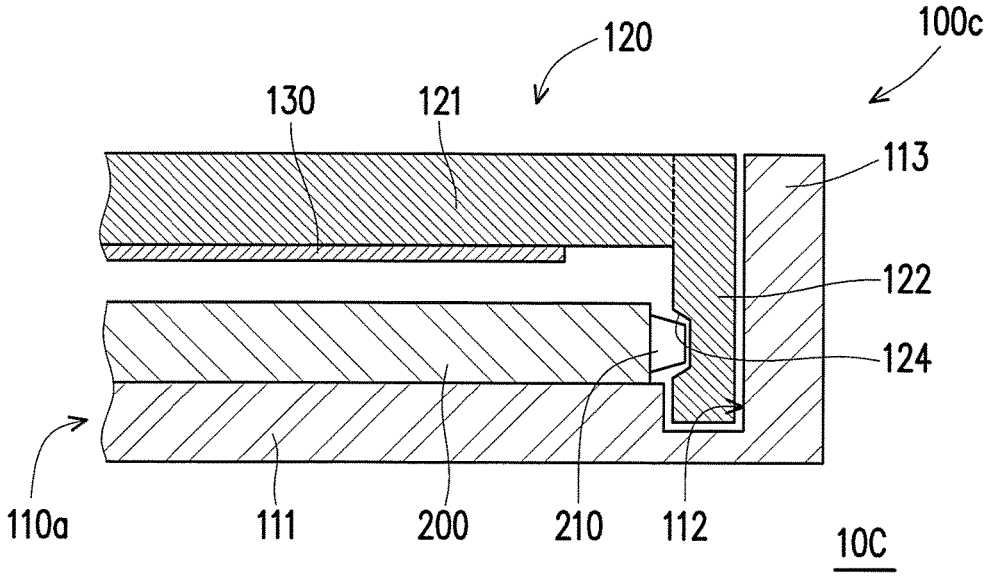
FIG. 4 is a partial sectional view illustrating an electronic assembly according to another embodiment of the application.

FIG. 4 is a partial sectional view illustrating an electronic assembly according to another embodiment of the application. Please refer to FIG. 4. In FIG. 4, an electronic assembly 10C is substantially similar to the electronic assembly 10A shown by FIG. 2. The main difference of them lies in that the second plate portion 121 of the packing box 100*c* does not include the pivot member 123 and the elastic member 125. In the embodiment, the second plate portion 121 is connected to the actuation portion 122 and may be an integrally formed structure. On the other hand, a portion of the trigger component 210 may be disposed in the recess 124 of the actuation portion 122. Therefore, when the box cover 120 is separated from the box body 110, the actuation portion 122 abuts the trigger component 210 to actuate the trigger component 210.

In brief, in the electronic assembly of the application, the electronic device is accommodated between the box body and the box cover of the packing box, wherein the box cover is assembled on the box body and at least one portion of the box cover is separable from the box body. Specifically, the box cover has the second plate portion and the actuation portion which may move with respect to the second plate portion. When the box cover is assembled on the box body, the actuation portion is fixed in the limiting groove of the first plate portion of the box body. Furthermore, after the actuation portion is moved out of the limiting groove, the actuation portion moves (e.g., rotate or translate) toward the trigger component of the electronic device with respect to the second plate portion so as to actuate the trigger component and further correspondingly trigger the predetermined function of the electronic device, such as booting, playing pictures, playing videos, displaying text messages, playing audio signal or executing other applications. Accordingly, when the consumer unpacks the packing box to take out the electronic device, the above feature may bring surprise to the consumer with the new experience and adds value to the product.

Although the application has been disclosed by the above embodiments, the embodiments are not intended to limit the application. It will be apparent to those skilled in the art that various modifications and variations can be made to the structure of the application without departing from the scope or spirit of the application. Therefore, the protecting range of the application falls in the appended claims.

What is claimed is:

1. A packing box suitable for at least an electronic device, the packing box comprising:

a box body; and a box cover, at least a portion thereof separably assembled on the box body, the electronic device accommodated between the box body and the box cover, wherein when the box cover is separated from the box body, a power key switch of the electronic device is actuated by being abutted by an actuation portion of the box cover so as to correspondingly trigger a predetermined function of the electronic device.

2. The packing box according to claim 1, wherein the box body comprises a first plate portion, the box cover has a second plate portion and the actuation portion is connected to the second plate portion, the electronic device is disposed between the first plate portion and the second plate portion, the actuation portion is disposed to extend toward the first plate portion and correspond to the power key switch of the electronic device, and an interval is kept between the actuation portion and the power key switch of the electronic device.

3. The packing box according to claim 2, wherein when the box cover is separated from the box body, the actuation portion moves toward the power key switch of the electronic device with respect to the second plate portion to actuate the power key switch.

4. The packing box according to claim 2, wherein the box cover further comprises an elastic member, the elastic member connects the second plate portion and the actuation portion, and when the box cover is separated from the box body, the elastic member drives the actuation portion to move toward the power key switch of the electronic device with respect to the second plate portion such that the actuation portion actuates the power key switch.

5. The packing box according to claim 2, wherein the box body further comprises a limiting groove disposed on the first plate portion, and the actuation portion is fixed in the limiting groove when the box cover is not separated from the box body.

6. The packing box according to claim 2, wherein the actuation portion comprises a recess, and the recess is disposed corresponding to the power key switch of the electronic device.

7. The packing box according to claim 2, wherein the box body further comprises a limiting portion connected to the first plate portion, the limiting portion disposed at a side of the actuation portion, and the actuation portion is disposed between the limiting portion and the electronic device.

8. The packing box according to claim 2, further comprising:

a card disposed on the second plate portion and between the first plate portion and the second plate portion.

9. The packing box according to claim 1, wherein at least a side of the box cover is connected to the box body.

10. An electronic assembly, comprising:

a packing box, comprising:

a box body; and a box cover, at least a portion thereof separably assembled on the box body; and an electronic device accommodated between the box body and the box cover, the electronic device having a power key switch, wherein when the box cover is separated from the box body, the power key switch is actuated by being abutted by an actuation portion of the box cover so as to correspondingly trigger a predetermined function of the electronic device.

11. The electronic assembly according to claim 10, wherein the box body comprises a first plate portion, the box cover comprises a second plate portion and the actuation portion is movably connected to the second plate portion, the electronic device is disposed between the first plate portion and the second plate portion, the actuation portion is disposed to extend toward the first plate portion and correspond to the power key switch of the electronic device, and an interval is kept between the actuation portion and the power key switch of the electronic device.

12. The electronic assembly according to claim 11, wherein when the box cover is separated from the box body, the actuation portion moves toward the power key switch t of the electronic device with respect to the second plate portion to actuate the power key switch.

13. The electronic assembly according to claim 11, wherein the box cover further comprises an elastic member, the elastic member is connected to the second plate portion and the actuation portion, and when the box cover is separated from the box body, the elastic member drives the actuation portion to move toward the power key switch of the electronic device with respect to the second plate portion such that the actuation portion actuates the power key switch.

14. The electronic assembly according to claim 11, wherein the box body further comprises a limiting groove disposed on the first plate portion, and the actuation portion is fixed in the limiting groove when the box cover is not separated from the box body.

15. The electronic assembly according to claim 11, wherein the actuation portion comprises a recess, and the recess is disposed corresponding to the power key switch of the electronic device.

16. The electronic assembly according to claim 11, wherein the box body further comprises a limiting portion connected to the first plate portion, the limiting portion is disposed at a side of the actuation portion, and the actuation portion is disposed between the limiting portion and the electronic device.

17. The electronic assembly according to claim 11, wherein the packing box further comprises:

a card disposed on the second plate portion and between the first plate portion and the second plate portion.

18. The electronic assembly according to claim 10, wherein at least a side of the box cover is connected to the box body.

19. A method of opening an electronic assembly, the electronic assembly comprising a packing box and an electronic device, the packing box comprising a box body and a box cover assembled on the box body, and at least a portion of the box cover being separable from the box body, the electronic device accommodated between the box cover and the box body, the method of opening the electronic assembly comprising:

separating the box cover from the box body; and during separating the box cover from the box body, actuating the power key switch by abutting an actuation portion of the box cover onto the power key switch with so as to correspondingly trigger a predetermined function of the electronic device.

20. The method of opening the electronic assembly according to claim 19, wherein the predetermined function comprises booting, playing images, playing videos, displaying text messages, playing audio signal or executing applications.

* * * * *